US011370643B2

(12) United States Patent
Hasegawa et al.

(10) Patent No.: US 11,370,643 B2
(45) Date of Patent: Jun. 28, 2022

(54) FORKLIFT

(71) Applicant: MITSUBISHI HEAVY INDUSTRIES, LTD., Tokyo (JP)

(72) Inventors: Noriyuki Hasegawa, Tokyo (JP); Kensuke Futahashi, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 281 days.

(21) Appl. No.: 16/775,826

(22) Filed: Jan. 29, 2020

(65) Prior Publication Data

US 2020/0307974 A1 Oct. 1, 2020

(30) Foreign Application Priority Data

Mar. 28, 2019 (JP) ..... JP2019-062550

(51) Int. Cl.

| | |
|---|---|
| ***B66F 9/075*** | (2006.01) |
| ***B66F 9/07*** | (2006.01) |
| ***B66F 9/10*** | (2006.01) |
| ***B66F 9/24*** | (2006.01) |

(52) U.S. Cl.

CPC ..... *B66F 9/0755* (2013.01); *B66F 9/07* (2013.01); *B66F 9/07554* (2013.01); *B66F 9/07559* (2013.01); *B66F 9/10* (2013.01); *B66F 9/24* (2013.01)

(58) Field of Classification Search

CPC ..... B66F 9/07554; B66F 9/07559; B66F 9/10

See application file for complete search history.

(56) References Cited

U.S. PATENT DOCUMENTS

| | | | | |
|---|---|---|---|---|
| 5,480,275 | A * | 1/1996 | Talbert | B66F 9/07559 187/226 |
| 9,045,320 | B2 * | 6/2015 | Turrini | B60P 3/1091 |
| 9,169,110 | B2 * | 10/2015 | Gerdes | B66F 9/07559 |
| 9,890,025 | B2 * | 2/2018 | Colantonio | B66F 9/07559 |
| 10,654,697 | B2 * | 5/2020 | Houle | B66F 9/07559 |
| 2005/0042068 | A1 * | 2/2005 | Ehmen | B66F 9/06 414/661 |
| 2012/0239262 | A1 * | 9/2012 | Reinert | B66F 9/07559 701/50 |
| 2017/0038779 | A1 | 2/2017 | Fujimori | |
| 2020/0071144 | A1 * | 3/2020 | Draayer | B66F 9/07504 |
| 2021/0039929 | A1 * | 2/2021 | Johansson | B65G 1/0492 |

FOREIGN PATENT DOCUMENTS

| | | |
|---|---|---|
| CN | 203402893 | 1/2014 |
| CN | 106429992 | 2/2017 |
| CN | 207090925 | 3/2018 |
| CN | 208394718 | 1/2019 |
| JP | 49-8164 | 2/1974 |
| JP | 2000-344483 | 12/2000 |
| JP | 2002-80195 | 3/2002 |
| JP | 2008-254877 | 10/2008 |

* cited by examiner

*Primary Examiner* — Mark C Hageman

(74) *Attorney, Agent, or Firm* — Wenderoth, Lind & Ponack, L.L.P.

(57) ABSTRACT

A forklift includes a vehicle body, a fork having a distal end extending in a first direction of a first axis, a mast extending along a second axis intersecting the first axis and holding a proximal end of the fork such that the fork is configured to slide along the second axis, and a first sliding mechanism configured to cause the mast to slide along the first axis such that the distal end of the fork protrudes from the vehicle body.

6 Claims, 14 Drawing Sheets

FORKLIFT

CROSS-REFERENCE TO RELATED APPLICATION

Priority is claimed from Japanese Patent Application No. 2019-062550, filed Mar. 28, 2019, the content of which is incorporated herein by reference.

BACKGROUND OF THE INVENTION

Field of the Invention

The present invention relates to a forklift.

Description of Related Art

Forklifts are generally known as a machine used in cargo handling work.

Patent Document 1 discloses, for example, a forklift with a vehicle body and a fork.

PATENT DOCUMENTS

[Patent Document 1] Japanese Examined Patent Application, Second Publication No. S49-008164

SUMMARY OF THE INVENTION

The forklift disclosed in Patent Document 1 is a mechanism having a distal end of a fork protruding from a pinion at the center of the vehicle body on which cargo is loaded, and thus a large moment occurs at a proximal end of the fork held by the pinion when cargo is loaded on the distal end of the fork.

Thus, mechanical strength may become insufficient.

The present invention aims to provide a forklift that is unlikely to have insufficient mechanical strength.

According to a first aspect of the present invention, a forklift includes a vehicle body, a fork having a distal end extending in one direction of a first axis, a mast extending along a second axis intersecting the first axis and holding a proximal end of the fork such that the fork slides along the second axis, and a first sliding mechanism that is configured to cause the mast to slide along the first axis so that the distal end protrudes from the vehicle body.

According to the present aspect, the distal end of the fork can be caused to protrude with respect to the vehicle body as the mast holding the proximal end of the fork slides in a direction along the first axis.

Thus, in the forklift, a moment occurring at the proximal end of the fork held by the mast can be prevented, even when the distal end of the fork is caused to protrude toward cargo and the cargo is loaded on the distal end of the fork.

Therefore, the forklift is unlikely to have insufficient mechanical strength.

According to a second aspect of the present invention, the forklift according to the first aspect further includes an acceleration information acquisition unit that is configured to acquire acceleration information regarding an acceleration of the forklift and a control unit that is configured to control a sliding amount of the mast on the first axis on the basis of the acceleration information.

According to the present aspect, the forklift can control a position of the mast in a direction along the first axis in relation to an acceleration.

Thus, the forklift can control sliding of the mast such that the forklift does not fall at the time of acceleration/deceleration.

According to a third aspect of the present invention, in the forklift according to the second aspect, the control unit is configured to shift a position of the mast along the first axis in a travel direction at the time of acceleration of the vehicle body.

According to the present aspect, the forklift can shift the center of gravity of the forklift in the travel direction at the time of acceleration of the vehicle body.

Thus, the forklift can be prevented from falling in the direction opposite to the travel direction at the time of acceleration of the vehicle body.

According to a fourth aspect of the present invention, in the forklift according to the second aspect, the control unit is configured to shift a position of the mast along the first axis in a direction opposite to the travel direction at the time of deceleration of the vehicle body.

According to the present aspect, the forklift can shift the center of gravity in the direction opposite to the travel direction at the time of deceleration of the vehicle body.

Thus, the forklift can be prevented from falling in the travel direction at the time of deceleration of the vehicle body.

According to a fifth aspect of the present invention, the forklift according to any one of the second to the fourth aspects further includes an outrigger extending in the one direction of the first axis, and the control unit is configured to cause the outrigger to protrude from the vehicle body when the fork is caused to protrude from the vehicle body.

According to the present aspect, the outrigger can support the vehicle body when the fork is caused to protrude.

Thus, the forklift can be prevented from falling in the direction in which the fork protrudes.

According to a sixth aspect of the present invention, the forklift according to any one of the second to the fifth aspects includes a counterweight and a third sliding mechanism that is configured to cause the counterweight to slide along the first axis with respect to the vehicle body, and the control unit is configured to cause the counterweight to protrude from the vehicle body in a direction opposite to a direction in which the fork is caused to protrude when the fork is caused to protrude from the vehicle body.

According to the present aspect, the forklift can shift the center of gravity in the direction opposite to the direction in which the fork is caused to protrude when the fork is caused to protrude.

Thus, the forklift can be prevented from falling in the direction in which the fork protrudes.

According to a seventh aspect of the present invention, in the forklift according to the sixth aspect, the control unit is configured to calculate a position of the center of gravity of the forklift having cargo, and adjusts a sliding amount of the counterweight along the first axis to maintain the calculated position of the center of gravity According to the present aspect, the forklift can be prevented from falling in the direction along the first axis since the forklift can maintain the position of the center of gravity thereof when cargo is lifted or carried.

According to the present invention, the forklift is unlikely to have insufficient mechanical strength.

DETAILED DESCRIPTION OF THE INVENTION

Figure 1:
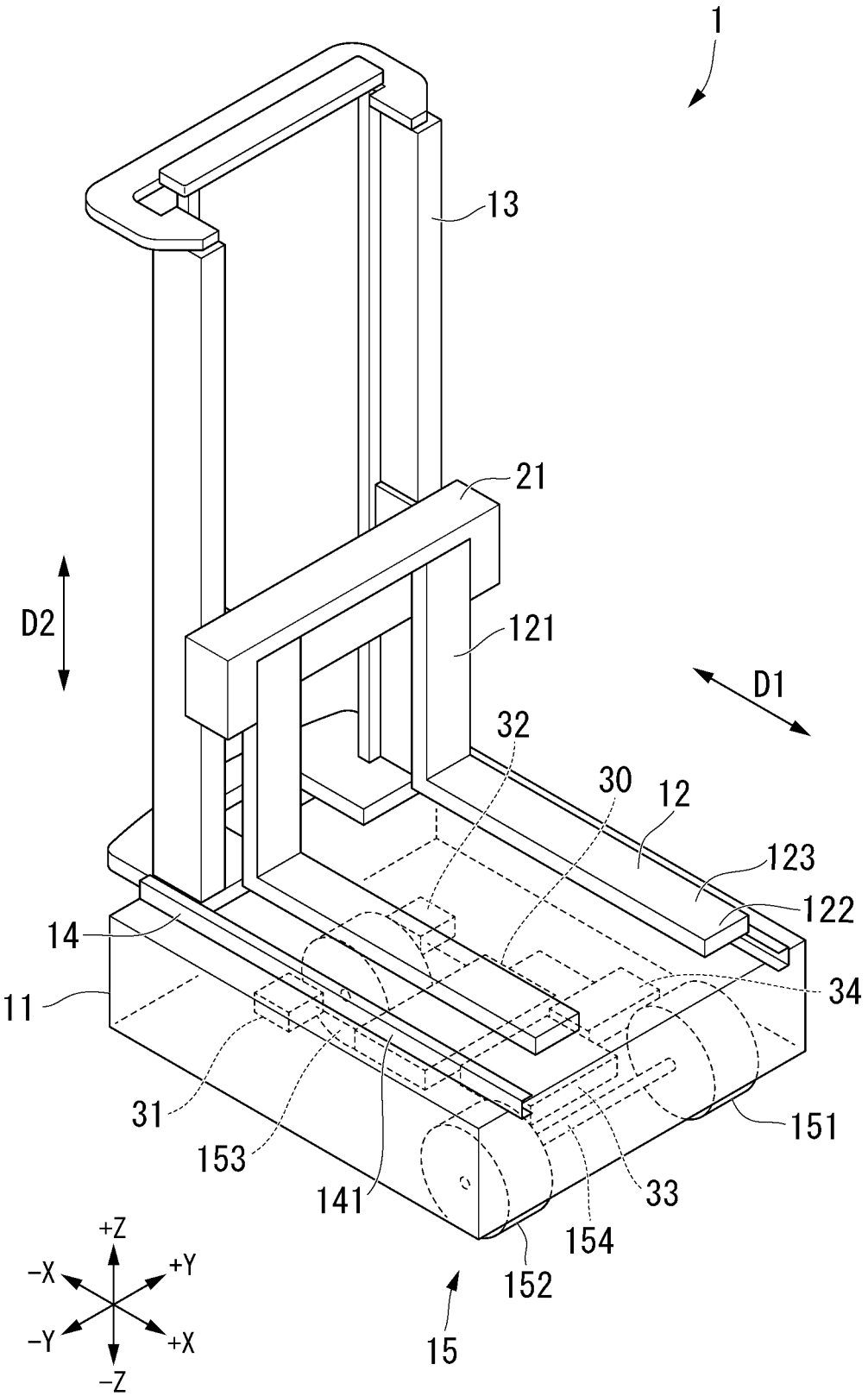
FIG. 1 is a perspective view showing an overall configuration of a forklift according to a first embodiment.

Each of embodiments according to the present invention will be described below using the drawings. The same reference numerals are given to the same or equivalent configurations in all of the drawings, and the common explanation will be omitted.

First Embodiment

A forklift according to a first embodiment will be described with reference to FIG. 1 to FIG. 4.

(Configuration)

An overall configuration of a forklift 1 according to the first embodiment will be described.

In the present embodiment, the forklift 1 is used to load and unload cargo on shelves in a warehouse and can travel in aisles inside the warehouse.

The forklift 1 is, for example, an unmanned forklift.

The forklift 1 includes a vehicle body 11, a fork 12, a mast 13, a first sliding mechanism 14, and a travel mechanism 15 as shown in FIG. 1.

Each of constituents of the mast 13 and the first sliding mechanism 14 is provided on, for example, a top surface of the vehicle body 11.

The forklift 1 may further include a battery 30, a first drive unit 31, a lift drive unit 32, a wheel drive unit 33, and a steering drive unit 34.

The fork 12 has a proximal end 121 and a distal end 122.

The proximal end 121 may extend in a longitudinal direction of the vehicle body 11.

The distal end 122 extends in one direction of a certain axis (a first axis).

The fork 12 extends, for example, in a first direction D1 from the proximal end 121 to the distal end 122.

The fork 12 may be provided on the vehicle body 11 via the mast 13 in the first direction D1 which is set to be, for example, a longitudinal direction of the vehicle body 11.

The distal end 122 of the fork 12 may face in a forward direction of the vehicle body 11.

The fork 12 may have a flat top surface 123.

Further, the longitudinal direction of the vehicle body 11 will also be called an X direction, a width direction of the vehicle body 11 will also be called a Y direction, and the longitudinal direction of the vehicle body 11 will also be called a Z direction.

Particularly, the forward direction of the vehicle body 11 will also be called a +X direction, and a backward direction of the vehicle body 11 will also be called a −X direction.

In addition, a left direction of the vehicle body 11 will also be called a +Y direction, and a right direction of the vehicle body 11 will also be called a −Y direction.

In addition, an upward direction of the vehicle body 11 will also be called a +Z direction, and a downward direction of the vehicle body 11 will also be called a −Z direction.

In addition, a direction intersecting the first direction D1 will be called a second direction D2.

The second direction D2 may be, for example, the longitudinal direction of the vehicle body 11.

The mast 13 extends along a second axis intersecting the first axis and holds the proximal end of the fork 12 such that the fork 12 slides along the second axis.

The mast 13 extends, for example, in the second direction D2.

The mast 13 is provided, for example, to rise from the vehicle body 11 vertically upward.

The mast 13 holds the proximal end 121 of the fork 12 such that, for example, the fork 12 can slide in the second direction D2.

The mast 13 holds the proximal end 121 of the fork 12 such that, for example, the fork 12 can be raised and lowered.

The forklift 1 may further include, for example, a lift sliding mechanism 21. In this case, the mast 13 holds the proximal end 121 of the fork 12 via the lift sliding mechanism 21 such that the fork 12 can be raised and lowered.

The first sliding mechanism 14 causes the mast 13 to slide along the first axis to cause the distal end 122 to protrude from the vehicle body 11.

The first sliding mechanism 14, for example, holds the mast 13 to be capable of moving in the first direction D1 on the vehicle body 11.

The first sliding mechanism 14 holds the mast 13 to be capable of sliding in the first direction D1 such that, for example, the distal end 122 of the fork 12 protrudes from the vehicle body 11.

The first sliding mechanism 14 has, for example, a rail 141 extending in the first direction D1. Since a lower end of the mast 13 is fitted on the rail 141, the mast 13 can move in the first direction D1 while maintaining a posture of extending in the second direction D2.

The rail 141, for example, may extend in a horizontal direction, and the mast 13 may be capable of moving in the horizontal direction.

The travel mechanism 15 includes a left-front wheel 151, a right-front wheel 152, a rear wheel 153, and an axle 154.

The left-front wheel 151 is provided at a left-front part, the right-front wheel 152 is provided at a right-front part, and the rear wheel 153 is provided at a rear part of the vehicle body 11, respectively.

The left-front wheel 151, the right-front wheel 152, and the rear wheel 153 are supported to be capable of rotating with respect to the vehicle body 11.

Part of an outer circumferential surface of each of the left-front wheel 151, the right-front wheel 152, and the rear wheel 153 protrudes from the bottom of the vehicle body 11.

The axle 154 is a shaft extending to left and right in the vehicle body 11.

The left-front wheel 151 and the right-front wheel 152 are supported to be capable of rotating with respect to the vehicle body 11 via the axle 154.

For example, the left-front wheel 151 may be fixed to a left end of the axle 154, which is rotatably supported by the vehicle body 11, and the right-front wheel 152 may be fixed to a right end of the axle 154, respectively.

Accordingly, the vehicle body 11 is configured to be capable of traveling on a floor with the left-front wheel 151, the right-front wheel 152, and the rear wheel 153.

The battery 30 supplies electric power to each drive unit including the first drive unit 31, the lift drive unit 32, the wheel drive unit 33, and the steering drive unit 34.

The battery 30 may be provided, for example, inside the vehicle body 11.

The first drive unit 31 drives the first sliding mechanism 14.

The first sliding mechanism 14 can cause the mast 13 to slide in the first direction D1 using a driving force received from the first drive unit 31.

The first drive unit 31 includes a motor, for example, a rotary motor, a linear motor, or the like.

The first drive unit 31 may be provided, for example, inside the vehicle body 11.

The lift drive unit 32 drives the lift sliding mechanism 21.

The lift sliding mechanism 21 causes the fork 12 to slide in the second direction D2 using a driving force received from the lift drive unit 32.

The lift drive unit 32 includes a motor, for example, a rotary motor, a linear motor, or the like.

The lift drive unit 32 may be provided, for example, inside the vehicle body 11.

The wheel drive unit 33 drives the travel mechanism 15.

The travel mechanism 15 can cause the vehicle body 11 to travel using a driving force received from the wheel drive unit 33.

The wheel drive unit 33 may include a motor, for example, a rotary motor or a linear motor, or may include an engine.

The wheel drive unit 33, for example, rotates the axle 154 around its axis, and may rotate the left-front wheel 151 and the right-front wheel 152.

The wheel drive unit 33 may be provided, for example, inside the vehicle body 11.

The steering drive unit 34 changes a travel direction of the travel mechanism 15.

The travel mechanism 15 can change a travel direction of the vehicle body 11 to the left and right using a driving force received from the steering drive unit 34.

The steering drive unit 34 may include a motor, for example, a rotary motor or a linear motor, or may include an engine.

The steering drive unit 34 can cause rotation axes of the left-front wheel 151 and the right-front wheel 152 to turn left and right.

The steering drive unit 34, for example, may cause the axle 154 to turn left and right.

The steering drive unit 34 may be provided, for example, inside the vehicle body 11.

(Operation)

An operation performed when the forklift 1 places a container CN as cargo will be described.

Figure 2:
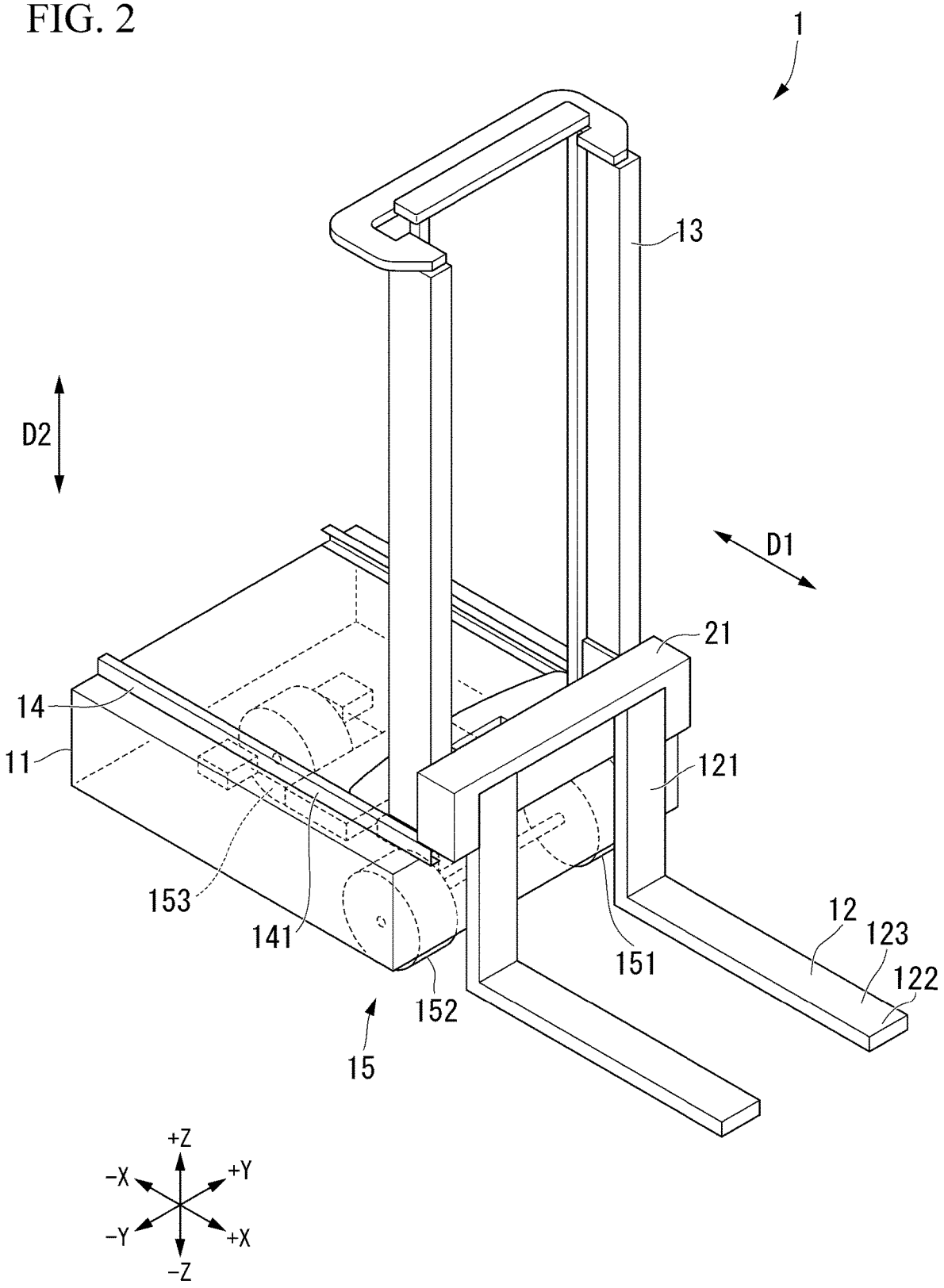
FIG. 2 is a perspective view showing an example of an operation of the forklift according to the first embodiment.

When the mast 13 slides in the +X direction due to the first sliding mechanism 14, the fork 12 is also caused to slide in the +X direction as shown in FIG. 2. Thus, the distal end 122 of the fork 12 protrudes from the front of the vehicle body 11.

After the distal end 122 of the fork 12 has been made to protrude from the front of the vehicle body 11 or while the distal end is protruding, the fork 12 may be raised or lowered via the lift sliding mechanism 21.

Figure 3:
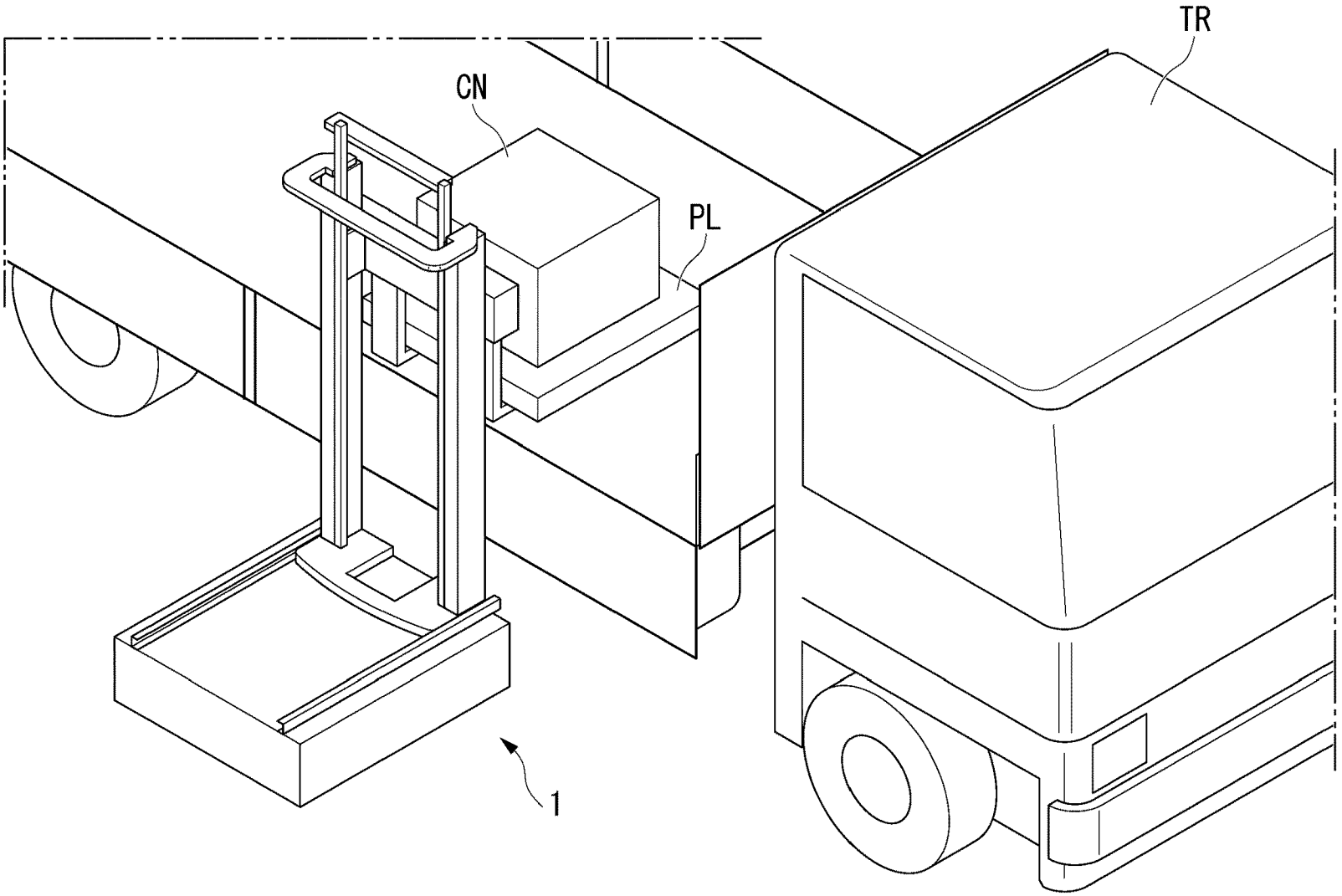
FIG. 3 is a perspective view showing an example of an operation of the forklift according to the first embodiment.

The distal end 122 of the fork 12 protrudes toward the container CN placed on a truck TR as the mast 13 slides in the +X direction, and the fork 12 is inserted below the bottom of the pallet PL on which the container CN is being placed as shown in FIG. 3.

Then, the fork 12 that has been inserted below the bottom of the pallet PL is raised, the pallet PL is lifted on the top surface 123 of the fork 12, and thereby the forklift 1 can lift the container CN.

Then, as the mast 13 slides in the −X direction, the forklift 1 can carry the container CN on the vehicle body 11 and travel.

In addition, conversely, when the distal end 122 of the fork 12 protrudes as the mast 13 slides in the +X direction, and the fork 12 is lowered, the forklift 1 can unload the container CN on a loading platform of the truck TR, a floor of a warehouse, or the like.

The forklift 1 with the container CN placed thereon can travel in, for example, aisles of a warehouse.

A plurality of forklifts 1, for example, may travel in the aisles in tandem inside the warehouse.

Figure 4:
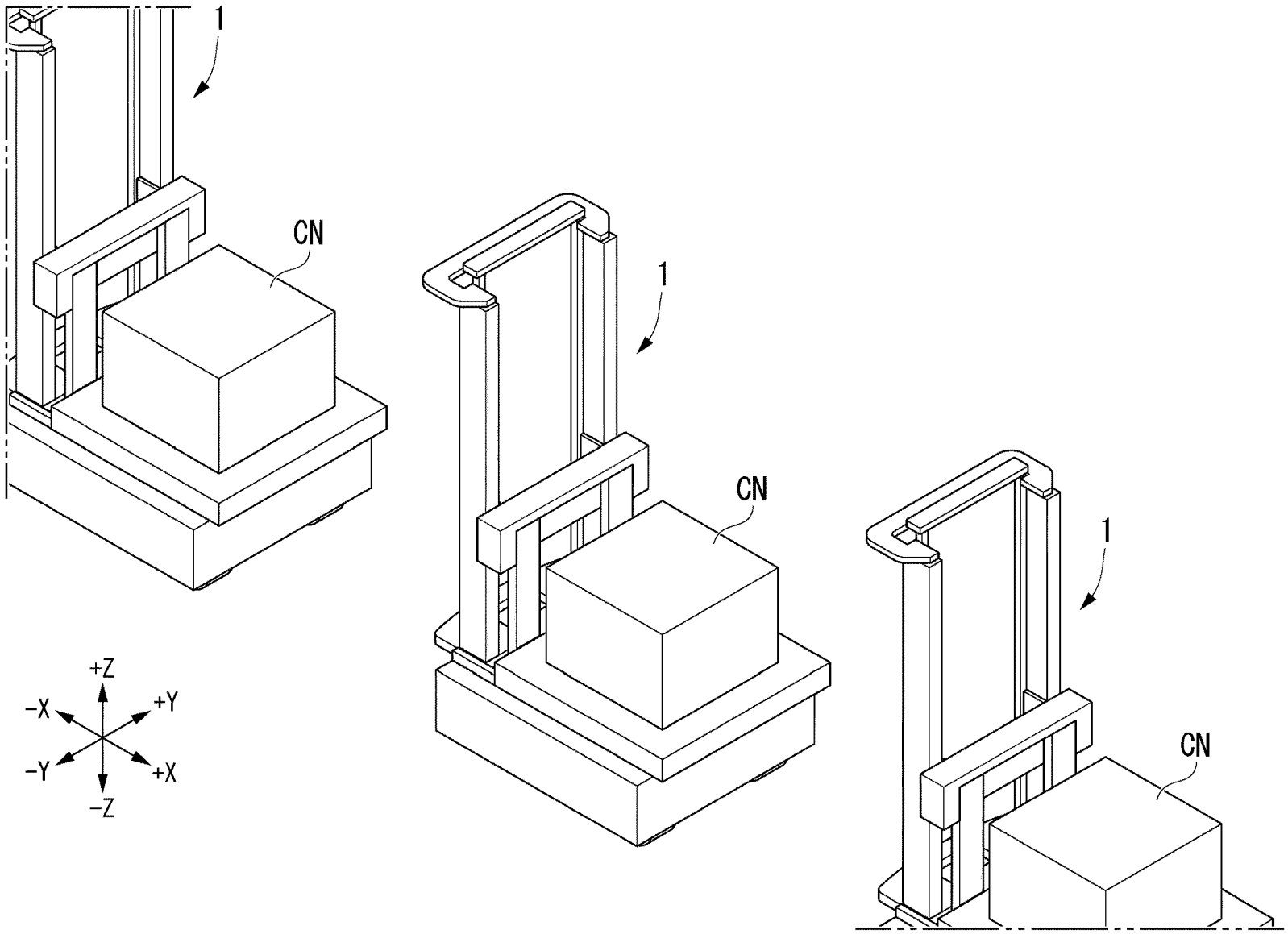
FIG. 4 is a perspective view showing an example of an operation of the forklift according to the first embodiment.

For example, at least three forklifts 1 may travel in the aisles in tandem inside the warehouse as shown in FIG. 4.

(Actions and Effects)

According to the present embodiment, when the mast 13 holding the proximal end of the fork 12 slides in the first direction D1, the distal end 122 of the fork 12 can protrude from the vehicle body 11.

Thus, even when the forklift 1 has the distal end 122 of the fork 12 protruding toward the container CN and thus the container CN is placed at the distal end 122 of the fork 12, a moment occurring at the proximal end 121 of the fork 12 held by the mast 13 can be reduced.

Therefore, the forklift is unlikely to have insufficient mechanical strength.

In addition, according to the embodiment, the forklift 1 is configured such that the first sliding mechanism 14 is provided on the vehicle body 11 and the mast 13 can move forward and backward on the vehicle body.

An aisle needs to have a width that is equivalent to the sum of a size of the container CN and a size of the vehicle body 11 to allow the forklift 1 to make a turn.

With regard to this, in the present embodiment, the mast 13 is caused to recede to an appropriate position during transport of the container CN after the container CN is placed on the forklift 1 (after loading) to carry the container CN, and thereby the center of turning of the forklift 1 becomes close to the center of the container CN.

Thus, a turning radius of the forklift 1 can be reduced. At the same time, the center of gravity of the container CN becomes close to the center of the vehicle body 11.

Therefore, the forklift 1 can take a stable posture during travel.

Second Embodiment

A forklift according to a second embodiment will be described with reference to FIG. 5 to FIG. 8.

In the second embodiment, a forklift 1 has a function of controlling sliding of a mast 13 in a first direction D1 in relation to acceleration information, in addition to the functions introduced in the first embodiment.

Further, each of constituent elements included in the forklift 1 of the second embodiment is similarly configured and functions similarly to those of the first embodiment unless specified otherwise, and thus overlapping description will be omitted.

(Configuration)

Figure 5:
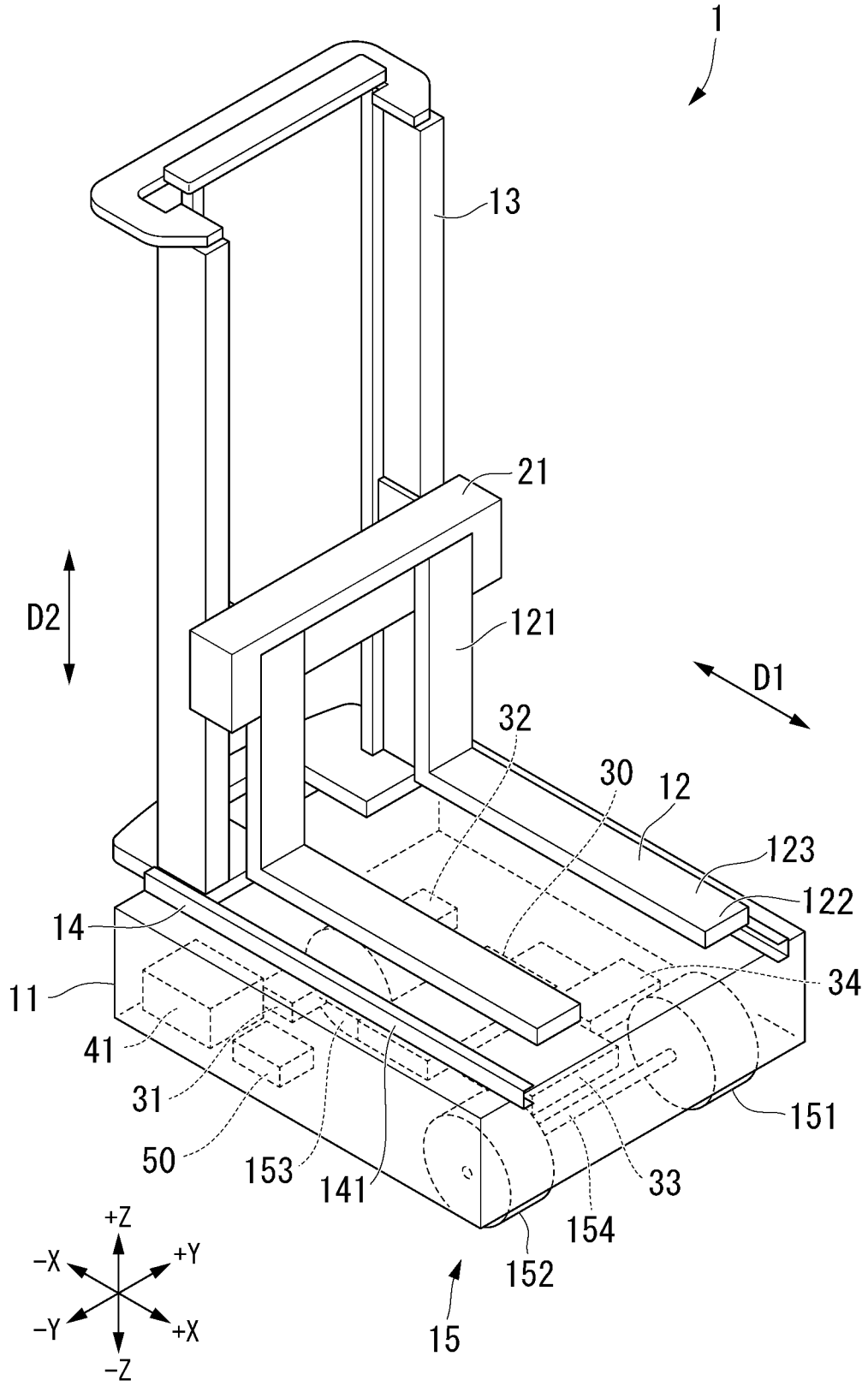
FIG. 5 is a perspective view showing an overall configuration of a forklift according to a second embodiment.

In the present embodiment, the forklift 1 further includes a first control unit 41 as shown in FIG. 5.

The forklift 1 may further include, for example, an acceleration sensor 50.

Figure 6:
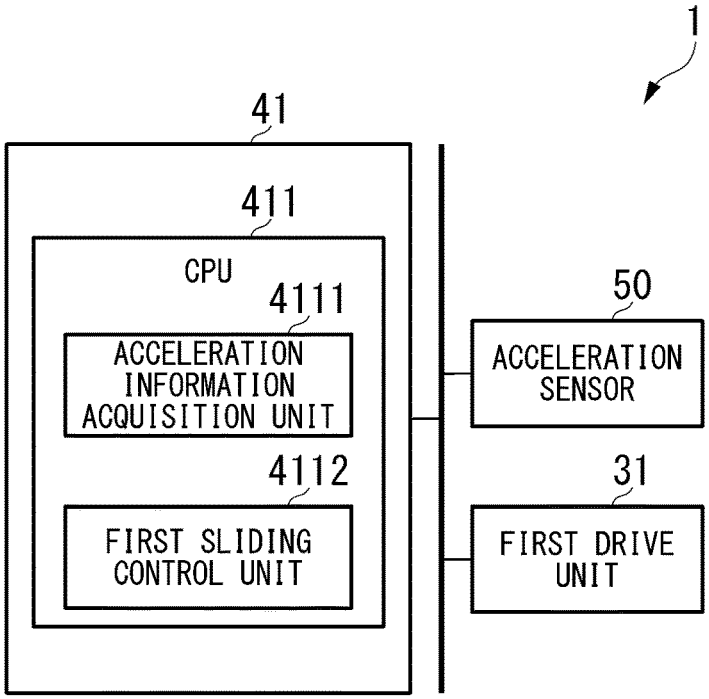
FIG. 6 is a block diagram of a first control unit according to the second embodiment.

The first control unit 41 includes a central processing unit (CPU) 411 as shown in FIG. 6.

The CPU 411 may functionally include, for example, an acceleration information acquisition unit 4111 and a first sliding control unit 4112.

The acceleration information acquisition unit 4111 acquires acceleration information regarding accelerations of the forklift 1.

The acceleration information acquisition unit 4111 acquires, for example, an acceleration of the vehicle body 11 detected by the acceleration sensor 50 as acceleration information regarding an acceleration of the forklift 1.

The acceleration sensor 50 is fixed to the vehicle body 11, detects an acceleration of the vehicle body 11 as an acceleration of the forklift 1, and outputs the detected acceleration to the acceleration information acquisition unit 4111.

The first sliding control unit 4112 (control unit) controls an amount of the mast 13 sliding on a first axis on the basis of the acceleration information.

At the time of acceleration of the vehicle body 11, the first sliding control unit 4112 is configured to shift a position of the mast 13 along the first axis.

At the time of deceleration of the vehicle body 11, the first sliding control unit 4112 is configured to shift a position of the mast 13 along the first axis in the direction opposite to a travel direction.

The first sliding control unit 4112 controls, for example, sliding of the mast 13 in the first direction D1 in relation to the acquired acceleration information.

The first sliding control unit 4112 may control a sliding amount SL by, for example, controlling driving of the first drive unit 31 in relation to the acquired acceleration information.

At the time of acceleration of the vehicle body 11, for example, the first sliding control unit 4112 is configured to shift a position of the mast 13 in the first direction D1 in a travel direction.

At the time of deceleration of the vehicle body 11, for example, the first sliding control unit 4112 is configured to shift a position of the mast 13 in the first direction D1 in the direction opposite to the travel direction.

(Operation)

Figure 7:
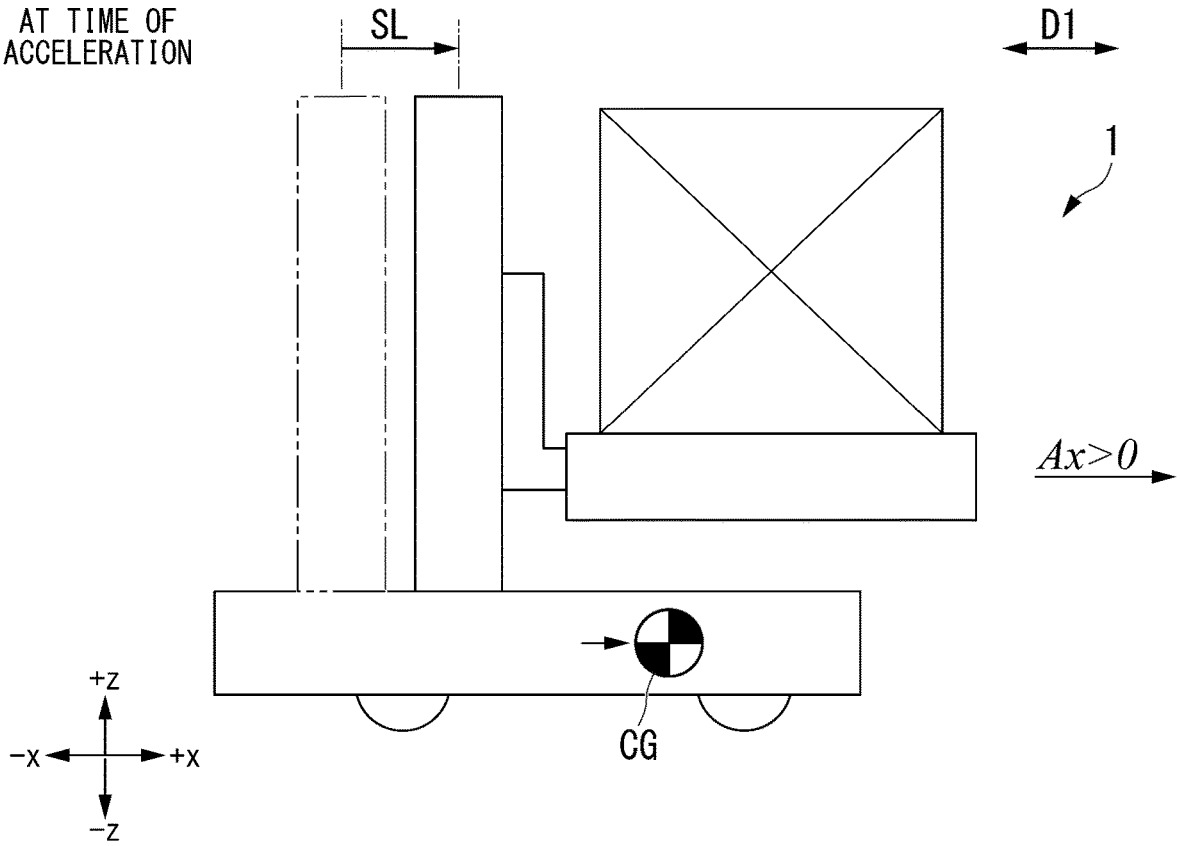
FIG. 7 is a side view showing an example of an operation of the forklift according to the second embodiment.

At the time of acceleration of the forklift 1, the first sliding control unit 4112 shifts the mast 13 in the first direction D1 for the travel direction of the forklift 1 as shown in FIG. 7.

For example, the forklift 1 is assumed to acceleration in the +X direction. In other words, an acceleration Ax of the forklift 1 is assumed to satisfy Ax>0 in the +X direction.

In this case, the first sliding control unit 4112 calculates the sliding amount SL in relation to the acceleration Ax of the forklift 1.

The first sliding control unit 4112 shifts the mast 13 from an initial position (the position at the acceleration Ax=0) in the +X direction by the calculated sliding amount SL.

The first sliding control unit 4112 may calculate the sliding amount SL such that, for example, the sliding amount SL increases in accordance with a magnitude (absolute value) of the acceleration Ax.

Accordingly, the forklift 1 can shift a position of the center of gravity CG at the initial position (the position at the acceleration Ax=0) in the +X direction.

Figure 8:
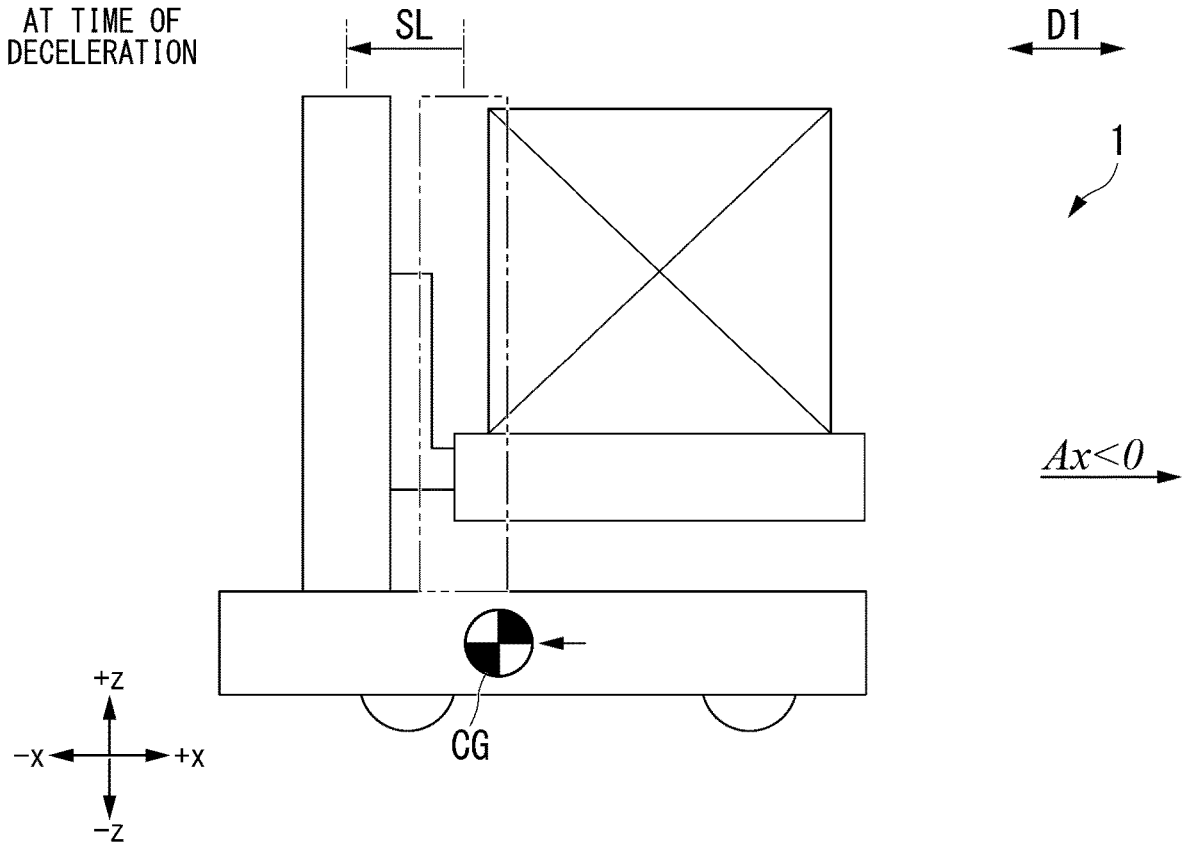
FIG. 8 is a side view showing an example of an operation of the forklift according to the second embodiment.

At the time of deceleration of the forklift 1, the first sliding control unit 4112 shifts a position of the mast 13 in the first direction D1 in the direction opposite to the travel direction of the forklift 1 as shown in FIG. 8.

The sliding amount SL may be calculated such that, for example, the sliding amount SL increases in accordance with a magnitude (absolute value) of the acceleration Ax.

For example, the forklift 1 is assumed to decelerate in the +X direction. In other words, the acceleration Ax of the forklift 1 is assumed to satisfy Ax<0 in the +X direction.

In this case, the first sliding control unit 4112 calculates the sliding amount SL in relation to the acceleration Ax of the forklift 1.

The first sliding control unit 4112 shifts the mast 13 from the initial position (the position at the acceleration Ax=0) in the −X direction by the calculated sliding amount SL.

The first sliding control unit 4112 may calculate the sliding amount SL such that, for example, the sliding amount SL increases in accordance with the magnitude (absolute value) of the acceleration Ax.

Accordingly, the forklift 1 can shift a position of the center of gravity CG at the initial position (the position at the acceleration Ax=0) in the −X direction.

(Actions and Effects)

According to the present embodiment, the forklift 1 can control sliding of the mast 13 in relation to the acceleration Ax.

For this reason, the forklift 1 can control positions of the mast 13 in the first direction D1 so that the forklift 1 is unlikely to fall at the time of acceleration and deceleration.

The forklift 1 can shift the center of gravity of the forklift 1, for example, in the travel direction at the time of acceleration.

Thus, the forklift 1 can be prevented from falling in the direction opposite to the travel direction at the time of acceleration.

The forklift 1 can shift the center of gravity of the forklift 1, for example, in the direction opposite to the travel direction at the time of deceleration.

Thus, the forklift 1 can be prevented from falling in the travel direction at the time of deceleration.

Forklifts are generally likely to fall backward at the time of acceleration and to fall forward at the time of deceleration.

With regard to this problem, the forklift 1 can control sliding of the mast 13 in relation to the acceleration Ax in the present embodiment as described above, and thus the forklift 1 can shift the mast 13 forward at the time of acceleration and shift the mast 13 backward at the time of deceleration.

The forklift 1 of the present embodiment may further change the sliding amount SL of the mast 13 in accordance with a weight of the container CN.

For example, the forklift 1 may acquire each of loads detected by a load sensor provided on a top surface of the distal end 122 of the fork 12, a load sensor provided in the mast 13, and the like, acquire information regarding a weight of the container CN, and change the sliding amount SL of the mast in accordance with the weight of the container CN.

The forklift 1 of the present embodiment may acquire any type of acceleration information as long as acceleration information in relation to an acceleration of the forklift 1 can be acquired.

The forklift 1 may acquire information simply indicating acceleration or deceleration as acceleration information.

In this case, the forklift 1 may perform control of causing the mast 13 to slide in the travel direction at the time of acceleration and causing the mast 13 to slide in the direction opposite to the travel direction at the time of deceleration as sliding control for the mast 13.

The forklift 1 may perform control of, for example, causing the mast 13 to slide by each of predetermined sliding amounts.

The forklift 1 may perform control of, for example, causing the mast 13 to slide forward at the time of acceleration and causing the mast 13 to slide backward at the time of deceleration.

Third Embodiment

A forklift according to a third embodiment will be described with reference to FIG. 9 to FIG. 11.

In the third embodiment, the forklift 1 has a function of causing an outrigger to protrude in accordance with protrusion of the fork 12, in addition to functions introduced in the first embodiment.

Further, each of constituent elements provided in the forklift 1 of the third embodiment has a similar configuration and function to those of the first embodiment unless specified otherwise, and thus overlapping description thereof will be omitted.

(Configuration)

Figure 9:
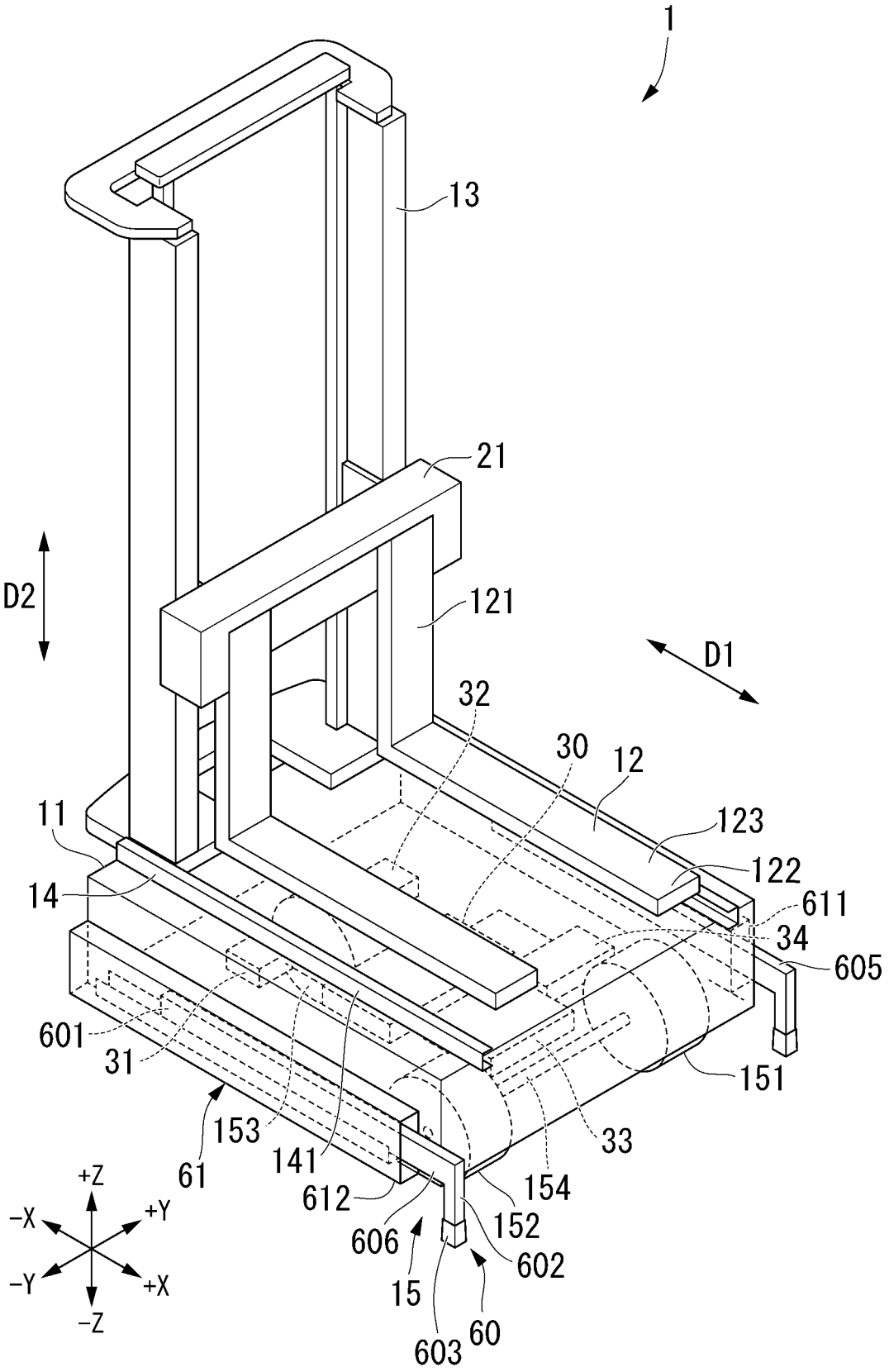
FIG. 9 is a perspective view showing an overall configuration of a forklift according to a third embodiment.

In the present embodiment, the forklift 1 further includes an outrigger 60 and a second sliding mechanism 61 as shown in FIG. 9.

The outrigger 60 extends in one direction on a first axis.

The outrigger 60 extends, for example, from a proximal end 601 to a distal end 602 in a first direction D1.

The outrigger 60 may extend, for example, in a horizontal direction.

The distal end 602 of the outrigger 60 may face a forward direction of the vehicle body 11.

The outrigger 60 has a grounding part 603 protruding downward at the distal end 602.

Accordingly, the outrigger 60 can support the vehicle body 11.

The forklift 1 may include a plurality of outriggers 60.

The forklift 1 may include a left outrigger 605 and a right outrigger 606 as a plurality of outriggers 60.

The left outrigger 605 is provided on a left side of the vehicle body 11 via the second sliding mechanism 61.

The right outrigger 606 is provided on a right side of the vehicle body 11 via the second sliding mechanism 61.

The second sliding mechanism 61 holds the proximal end 601 of the outrigger 60 such that the outrigger 60 can slide in the first direction D1 with respect to the vehicle body 11.

The second sliding mechanism 61 extends in the first direction D1 along the outrigger 60.

The forklift 1 may include a plurality of second sliding mechanisms 61.

The forklift 1 may include a left second sliding mechanism 611 and a right second sliding mechanism 612 as a plurality of second sliding mechanisms 61.

The left second sliding mechanism 611 is provided on a left side surface of the vehicle body 11. The left second sliding mechanism 611 holds the left outrigger 605 to be capable of sliding in the first direction D1.

The right second sliding mechanism 612 is provided on a right side surface of the vehicle body 11. The right second sliding mechanism 612 holds the right outrigger 606 to be capable of sliding in the first direction D1.

The outrigger 60 may slide in the first direction D1 in conjunction with sliding of the mast 13 by mechanically connecting to the mast 13.

At this time, the outrigger 60 may be connected to the mast 13 in any form as long as it is mechanically connected to the mast 13.

The outrigger 60 may slide in the first direction D1 to move in a movement direction of the mast 13 in conjunction with sliding of the mast 13, for example, by being directly fixed to or being fixed to the mast 13 via a link mechanism to be integrated therewith. In this case, the forklift 1 may not include the second sliding mechanism 61 as long as the outrigger 60 can slide in the first direction D1 without the second sliding mechanism 61.

The outrigger 60 may slide in the first direction D1 to move in a movement direction of the mast 13, for example, by being mechanically connected to the mast 13 via a gear, a pulley, or the like.

The outrigger 60 may slide in the first direction D1 to move in a movement direction of the mast 13 in conjunction with sliding of the mast 13, for example, using electrical control.

Figure 10:
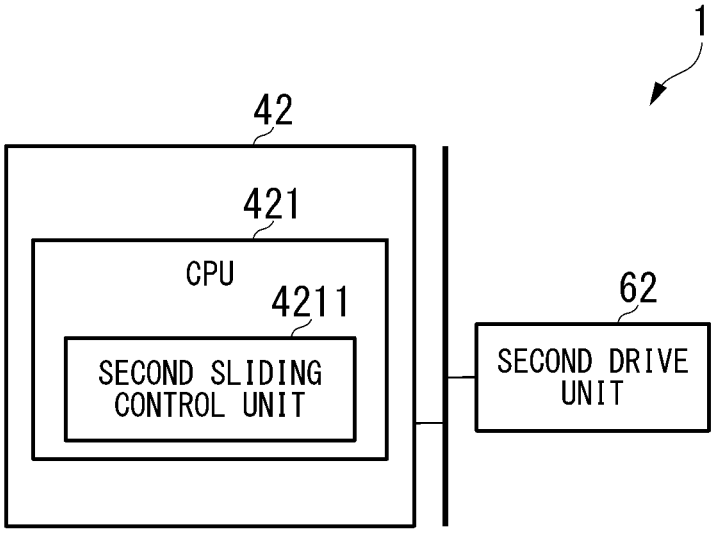
FIG. 10 is a block diagram of a second control unit according to the third embodiment.

The forklift 1 may further include, for example, a second drive unit 62 and a second control unit 42 as shown in FIG. 10.

The second drive unit 62 and the second control unit 42 may be provided inside the vehicle body 11.

The second drive unit 62 drives the second sliding mechanism 61.

A battery 30 supplies electric power to the second drive unit 62.

The second drive unit 62 includes a motor, for example, a rotary motor, a linear motor, or the like.

The second sliding mechanism 61 can cause the outrigger 60 to slide in the first direction D1 using a driving force received from the second drive unit 62.

The second control unit 42 includes a CPU 421.

The CPU 421 functionally includes a second sliding control unit 4211.

The second sliding control unit 4211 (control unit) causes the outrigger 60 to protrude from the vehicle body 11 when the fork 12 is caused to protrude from the vehicle body 11.

The second sliding control unit 4211 controls the second sliding mechanism 61 such that, for example, the outrigger 60 protrudes from a front part of the vehicle body 11 in accordance with the fork 12 protruding from the front part of the vehicle body 11 by the forklift 1.

The second sliding control unit 4211 may cause the outrigger 60 to protrude from a front part of the vehicle body 11, for example, by controlling driving of the second drive unit 62 in accordance with control of the first drive unit 31.

(Operation)

Figure 11:
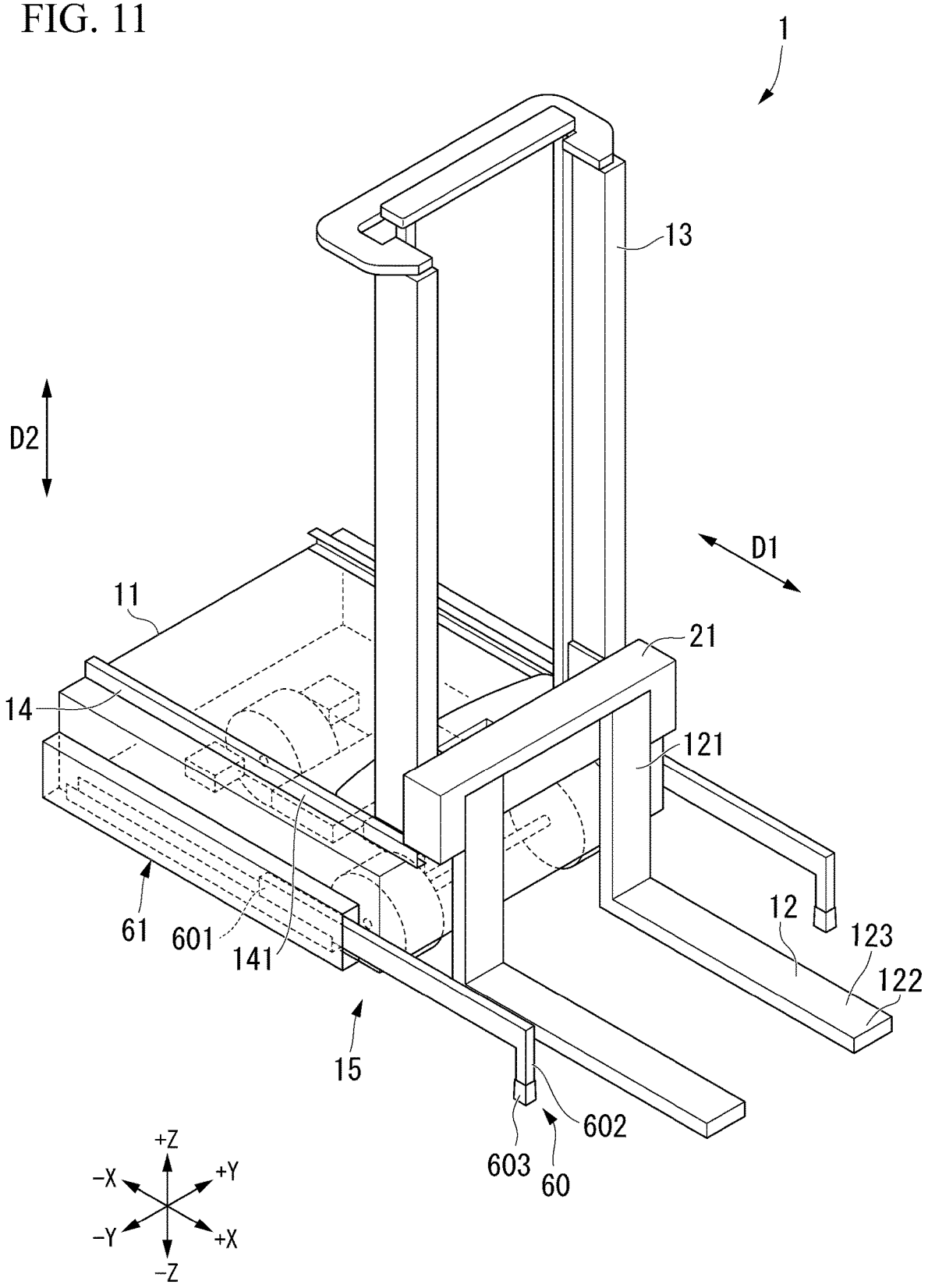
FIG. 11 is a perspective view showing an example of an operation of the forklift according to the third embodiment.

The outrigger 60 slides in the first direction D1 in conjunction with sliding of the mast 13 as shown in FIG. 11.

Accordingly, the forklift 1 causes the outrigger 60 to protrude from the vehicle body 11 in accordance with protrusion of the fork 12 from the vehicle body 11.

(Actions and Effects)

According to the present embodiment, the outrigger 60 can support the vehicle body 11 when the fork 12 is caused to protrude.

Thus, the forklift 1 can be prevented from falling in the direction in which the fork 12 protrudes.

Fourth Embodiment

A forklift according to a fourth embodiment will be described with reference to FIG. 12 to FIG. 16. In the fourth embodiment, the forklift 1 has a function of causing a counterweight to protrude in accordance with protrusion of the fork 12, in addition to functions introduced in the first embodiment.

Further, each of constituent elements provided in the forklift 1 of the fourth embodiment has a similar configuration and function to those of the first embodiment unless specified otherwise, and thus overlapping description thereof will be omitted.

(Configuration)

Figure 12:
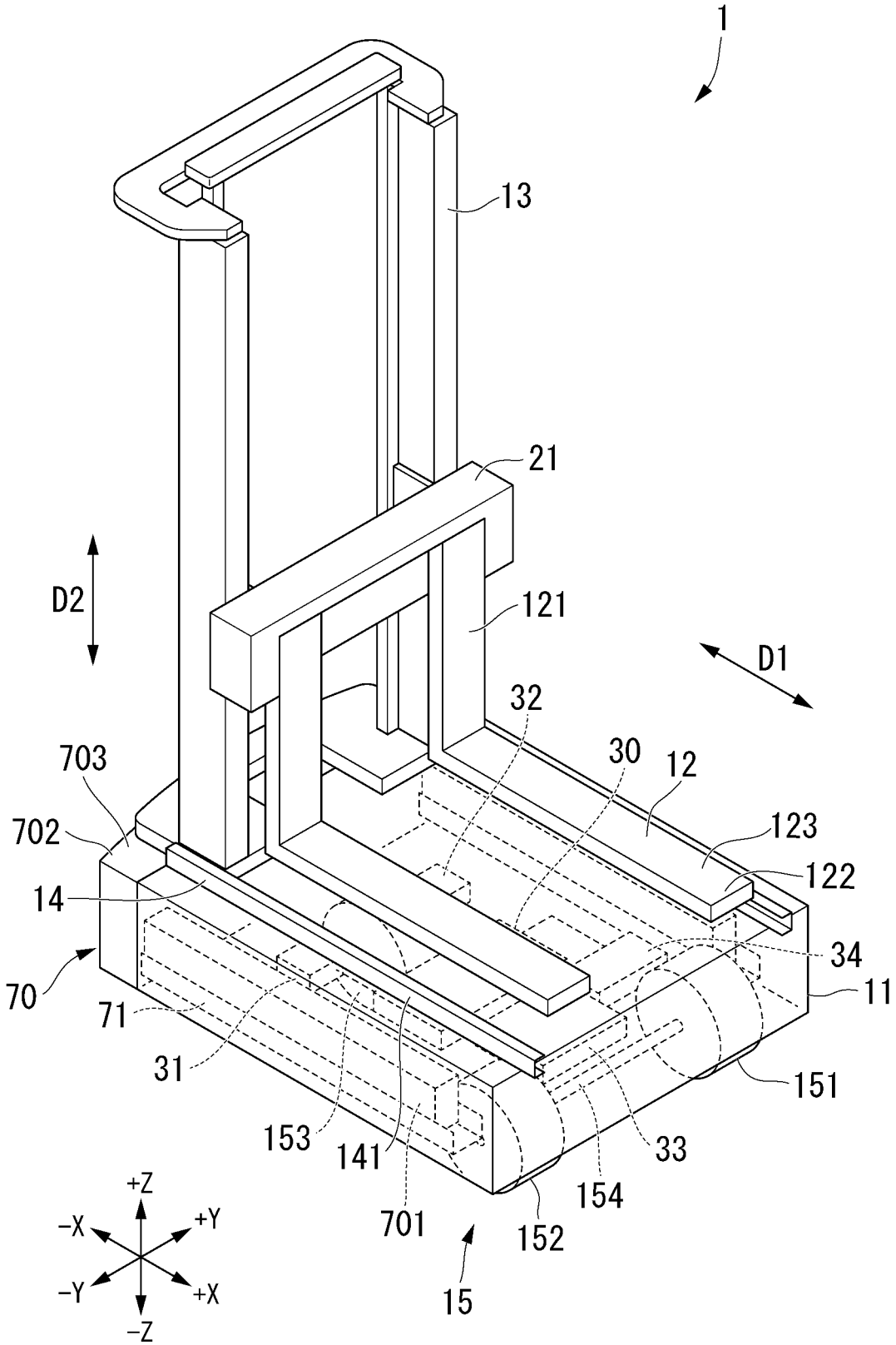
FIG. 12 is a perspective view showing an overall configuration of a forklift according to a fourth embodiment.

In the present embodiment, the forklift 1 further includes a counterweight 70 and a third sliding mechanism 71 as shown in FIG. 12.

The counterweight 70 extends from a proximal end 701 to a distal end 702 in the first direction D1.

The distal end 702 of the counterweight 70 faces the direction opposite to the distal end 122 of the fork 12 in the first direction D1.

The distal end 702 of the counterweight 70 faces, for example, backward of the vehicle body 11.

The counterweight 70 has a weight part 703 at the distal end 702.

The weight part 703 has a weight that can counterbalance the vehicle body 11, each drive unit, the container CN, and the like for preventing the forklift 1 from falling.

Thus, the counterweight 70 can shift the center of gravity of the forklift 1 in the first direction D1.

The third sliding mechanism 71 causes the counterweight 70 to slide along the first axis with respect to the vehicle body 11.

The third sliding mechanism 71, for example, holds the proximal end 701 of the counterweight 70 to be capable of sliding in the first direction D1 with respect to the vehicle body 11.

The third sliding mechanism 71, for example, extends in the first direction D1 along the counterweight 70.

The counterweight 70, for example, may slide in the first direction D1 in conjunction with sliding of the mast 13 by being mechanically connected to the mast 13.

At this time, the counterweight 70 may be connected to the mast 13 in any form as long as the counterweight 70 is mechanically connected to the mast 13.

The counterweight 70 may slide in the first direction D1 to move in a direction opposite to the movement direction of the mast 13, for example, by being mechanically connected to the mast 13 via a gear, a pulley, or the like.

The counterweight 70 may slide in the first direction D1 to move in the direction opposite to the movement direction of the mast 13 in conjunction with sliding of the mast 13, for example, using electrical control.

Figure 13:
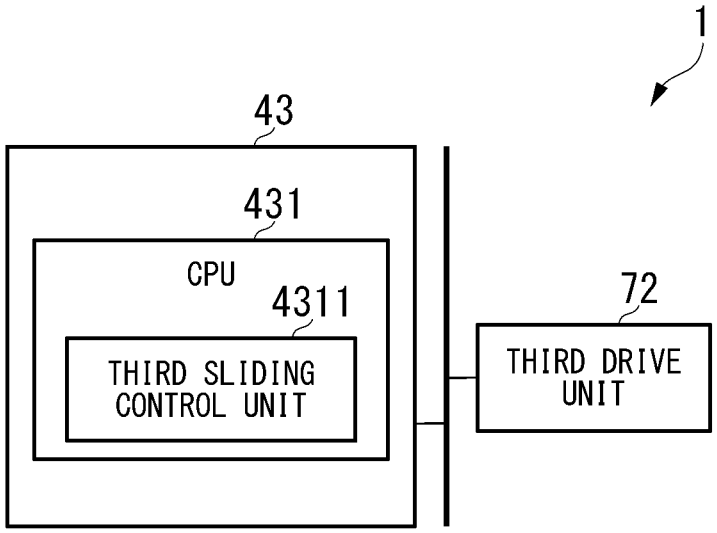
FIG. 13 is a block diagram of a third control unit according to the fourth embodiment.

The forklift 1 may further include, for example, a third drive unit 72 and a third control unit 43 as shown in FIG. 13.

The third drive unit 72 and the third control unit 43 may be provided, for example, inside the vehicle body 11.

The third drive unit 72 drives the third sliding mechanism 71.

A battery 30 supplies electric power to the third drive unit 72.

The third sliding mechanism 71 can cause the counterweight 70 to slide in the first direction D1 using a driving force received from the third drive unit 72.

The third drive unit 72 includes a motor, for example, a rotary motor, a linear motor, or the like.

The third control unit 43 includes a CPU 431.

The CPU 431 functionally includes a third sliding control unit 4311.

The third sliding control unit 4311 controls the third sliding mechanism 71 such that the third sliding mechanism 71 causes the counterweight 70 to protrude from a back of the vehicle body 11 in accordance with the forklift 1 causing the fork 12 to protrude from a front of the vehicle body 11.

The third sliding control unit 4311, for example, may cause the counterweight 70 to protrude from the back of the vehicle body 11 by controlling driving of the third drive unit 72 in accordance with control of the first drive unit 31.

(Operation)

Figure 14:
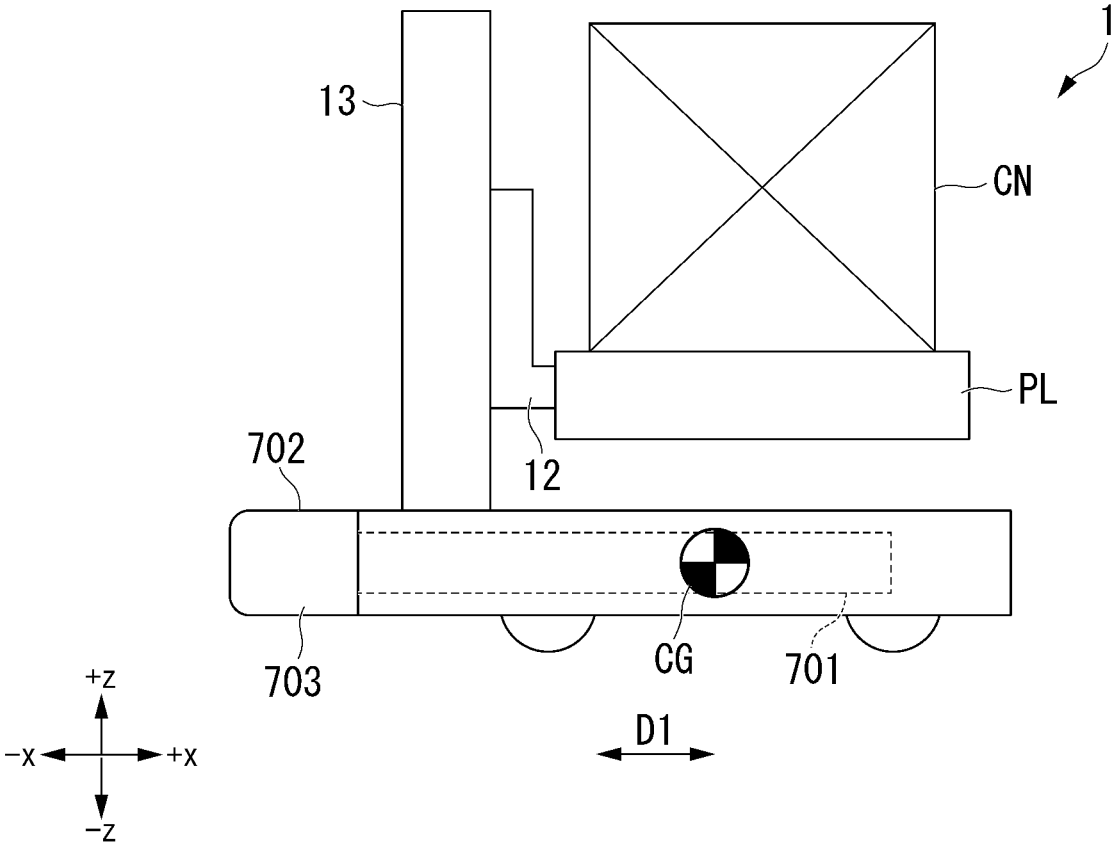
FIG. 14 is a side view showing an example of an operation of the forklift according to the fourth embodiment.
Figure 15:
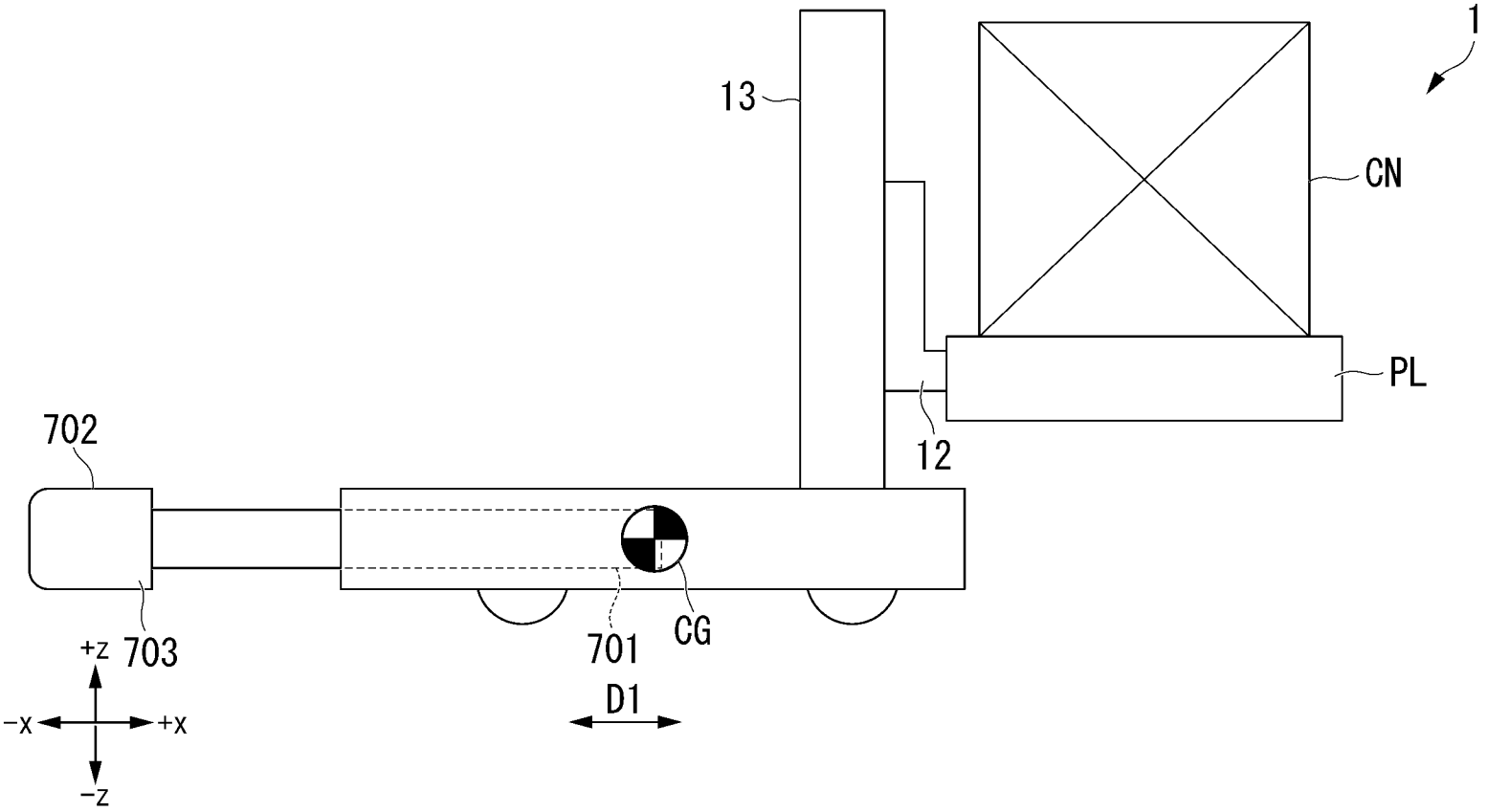
FIG. 15 is a side view showing an example of an operation of the forklift according to the fourth embodiment.

The counterweight 70 slides in the first direction D1 in conjunction with sliding of the mast 13 as shown in FIG. 14 and FIG. 15.

Accordingly, the forklift 1 can cause the counterweight 70 to protrude from the back of the vehicle body 11 in accordance with the fork 12 protruding from the front of the vehicle body 11.

(Actions and Effects)

According to the present embodiment, the forklift 1 can shift the center of gravity in the direction opposite to the direction in which the fork 12 protrudes when the fork 12 is caused to protrude.

In other words, the forklift 1 is configured such that the counterweight 70 stretches backward when the mast 13 moves forward.

The forklift 1, for example, can control sliding of the counterweight 70 in the first direction D1 in conjunction with sliding of the mast 13 in the first direction D1 so that a position of the center of gravity, which is a position of the center of gravity CG in the first direction D1, is set to less likely to change from near the center of the forklift 1.

Therefore, the forklift 1 can be prevented from falling in the direction in which the fork 12 protrudes.

Further, the forklift 1 of the present embodiment may change a sliding amount of the counterweight 70 in accordance with a weight of the container CN.

For example, the forklift 1 may acquire each of loads detected by a load sensor provided on a top surface of the distal end 122 of the fork 12, a load sensor provided in the mast 13, and the like, acquire information regarding a weight of the container CN, and change the sliding amount of the counterweight 70 in accordance with the weight of the container CN.

Figure 16:
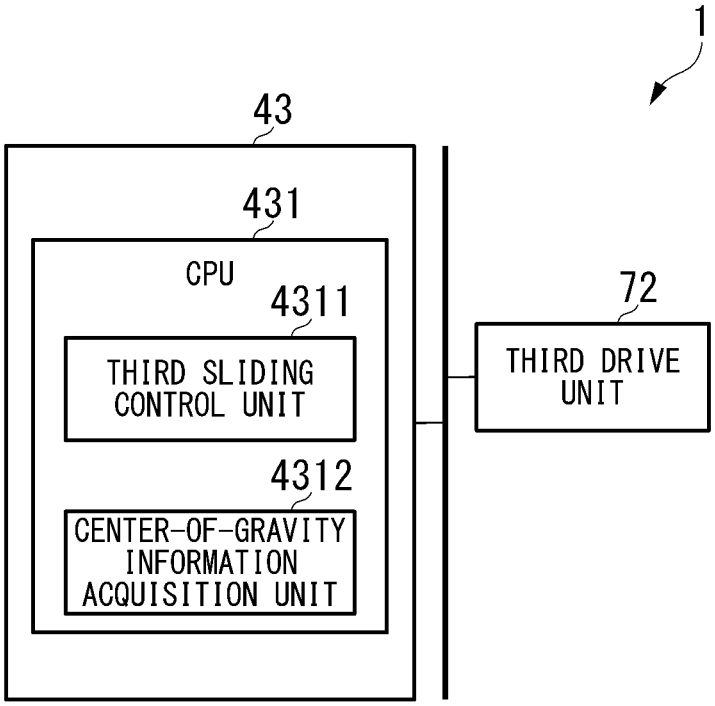
FIG. 16 is a block diagram of the third control unit according to the fourth embodiment.

The CPU 431 may further functionally include, for example, a center-of-gravity information acquisition unit 4312 as shown in FIG. 16.

The center-of-gravity information acquisition unit 4312 calculates a current position of the center of gravity of the forklift 1 having the container CN to be lifted or carried on the basis of each acquired load and outputs the result to the third sliding control unit 4311.

The third sliding control unit 4311 acquires the position of the center of gravity output from the center-of-gravity information acquisition unit 4312.

The third sliding control unit 4311 adjusts a sliding amount of the counterweight 70 on the first axis to maintain the calculated position of the center of gravity.

The third sliding control unit 4311 adjusts a sliding amount of the counterweight 70 in the first direction D1 to maintain the acquired position of the center of gravity over the period before and after the forklift 1 lifts or carries the container CN using, for example, feedback control.

Accordingly, the forklift 1 can maintain the position of the center of gravity of the forklift 1 having the container CN. Thus, the forklift 1 can be prevented from falling in the first direction D1.

Modified Example

In each of the above-described embodiments, configurations included in the forklift 1 may be combined with each other.

As a modified example, the outrigger 60 and the counterweight may be provided together in the forklift 1.

As another modified example, a plurality of control units among control units including the first control unit 41, the second control unit 42, and the third control unit 43 may be provided together in the forklift 1.

In that case, the control units may be integrated and configured to be one control unit or a CPU.

In the above-described second embodiment, the forklift 1 controls a position of the mast 13 in the first direction D1 in relation to a detected acceleration Ax.

As a modified example, the forklift 1 may cause an acceleration Ax to be stored in relation to a travel route in advance and control a position of the mast 13 in the first direction D1 in relation to the stored acceleration Ax.

In the above-described second embodiment, the forklift 1 controls a position of the mast 13 in the first direction D1 in relation to an acceleration Ax.

As a modified example, the counterweight 70 may be further provided in the forklift 1 of the above-described second embodiment, and the forklift 1 may control a position of the counterweight 70 in the first direction D1 in relation to an acceleration Ax, in addition to a position of the mast 13 in the first direction D1.

In each of the above-described embodiments, three wheels such as the left-front wheel 151, the right-front wheel 152, and the rear wheel 153 are provided in the forklift 1 as wheels.

As a modified example, rear wheels may be provided on the left and right, and four wheels or five or more wheels may be provided in the forklift 1 as wheels.

While several preferred embodiments of the present invention have been described and shown above, it should be understood that these are exemplary of the invention and are not to be considered as limiting the scope of the invention. The embodiments can be implemented in various forms, and omissions, substitutions, and other modifications can be made without departing from the spirit or scope of the present invention. The embodiments and modifications fall within the scope of the invention described in the appended claims and their equivalents as well as the scope and the gist of the invention.

INDUSTRIAL APPLICABILITY

The above-described forklift is unlikely to have insufficient mechanical strength.

EXPLANATION OF REFERENCES

1 Forklift
11 Vehicle body
12 Fork
13 Mast
14 First sliding mechanism
15 Travel mechanism
21 Lift sliding mechanism
30 Battery
31 First drive unit
32 Lift drive unit
33 Wheel drive unit
34 Steering drive unit
41 First control unit
42 Second control unit
43 Third control unit
50 Acceleration sensor
60 Outrigger
61 Second sliding mechanism
62 Second drive unit
70 Counterweight
71 Third sliding mechanism
72 Third drive unit
121 Proximal end
122 Distal end
123 Top surface
141 Rail
151 Left-front wheel
152 Right-front wheel
153 Rear wheel
154 Axle
601 Proximal end
602 Distal end
603 Grounding part
605 Left outrigger
606 Right outrigger
611 Left second sliding mechanism
612 Right second sliding mechanism
701 Proximal end
702 Distal end
703 Weight part
4111 Acceleration information acquisition unit
4112 First sliding control unit
4211 Second sliding control unit
4311 Third sliding control unit
4312 Center-of-gravity information acquisition unit
Ax Acceleration
CG Center of gravity
CN Container
D1 First direction
D2 Second direction
PL Pallet
SL Sliding amount
TR Truck

What is claimed is:

1. A forklift comprising:

a vehicle body;

a fork having a distal end extending in a first direction of a first axis;

a mast extending along a second axis intersecting the first axis and holding a proximal end of the fork such that the fork is configured to slide along the second axis;

a first sliding mechanism configured to cause the mast to slide along the first axis such that the distal end of the fork protrudes from the vehicle body so as to control a center of gravity of the forklift;

an acceleration information acquisition unit configured to acquire acceleration information regarding an acceleration of the forklift; and a control unit configured to control a sliding amount of the mast along the first axis based on the acceleration information, wherein:

the first sliding mechanism comprises a rail extending in the first direction of the first axis; and the mast has a lower end fitted on the rail so as to be capable of moving in the first direction of the first axis while maintaining a posture of extending along the second axis.

2. The forklift according to claim 1, wherein the control unit is configured to shift a position of the mast along the first axis in a travel direction at a time of acceleration of the vehicle body.

3. The forklift according to claim 1, wherein the control unit is configured to shift a position of the mast along the first axis in a direction opposite to a travel direction at a time of deceleration of the vehicle body.

4. The forklift according to claim 1, further comprising:

an outrigger extending in the first direction of the first axis, wherein the control unit is configured to cause the outrigger to protrude from the vehicle body when the fork is caused to protrude from the vehicle body.

5. The forklift according to claim 1, comprising:

a counterweight; and a second sliding mechanism configured to cause the counterweight to slide along the first axis with respect to the vehicle body, wherein the control unit is configured to cause the counterweight to protrude in a direction opposite to a direction in which the fork is caused to protrude from the vehicle body.

6. The forklift according to claim 5, wherein the control unit is configured to calculate a position of the center of gravity of the forklift having cargo and adjust a sliding amount of the counterweight along the first axis to maintain the position of the center of gravity which has been calculated.

* * * * *